US006212705B1

(12) United States Patent
Kramer

(10) Patent No.: US 6,212,705 B1
(45) Date of Patent: Apr. 10, 2001

(54) BATHTUB TRAY WITH DRAIN

(76) Inventor: Daniel J. Kramer, 7934 Billingham Rd., West Bloomfield, MI (US) 48324

( * ) Notice: Subject to any disclaimer, the term of this patent is extended or adjusted under 35 U.S.C. 154(b) by 0 days.

(21) Appl. No.: 09/421,607

(22) Filed: Oct. 20, 1999

Related U.S. Application Data

(60) Provisional application No. 60/107,320, filed on Nov. 6, 1998.

(51) Int. Cl.[7] ..... A47K 3/00

(52) U.S. Cl. ..... 4/559; 4/605; 108/42; 248/206.4

(58) Field of Search ..... 4/546–548, 551, 4/656, 559, 571.1, 578.1, 579, 631, 632, 637, 605; 108/1, 7, 24, 27, 42; 248/205.5, 206.2, 206.4

(56) References Cited

U.S. PATENT DOCUMENTS

| | | | | |
|---|---|---|---|---|
| D. 265,152 | | 6/1982 | Bruno et al. | D6/86 |
| D. 315,653 | | 3/1991 | Truffa | D6/524 |
| D. 343,321 | | 1/1994 | Emery | D6/566 |
| 1,422,718 | * | 7/1922 | Keehn | 4/572.1 |
| 2,456,845 | * | 12/1948 | Stine et al. | 4/572.1 |
| 4,053,954 | | 10/1977 | Chapman | 4/185 |
| 4,525,882 | * | 7/1985 | Stenberg | 4/559 |
| 4,955,093 | | 9/1990 | Klassen | 4/579 |
| 5,168,583 | * | 12/1992 | Wanke | 4/579 |
| 5,548,855 | | 8/1996 | Jackson | 4/559 |
| 5,621,927 | | 4/1997 | Reiss et al. | 4/559 |
| 5,669,313 | | 9/1997 | Cottingham | 108/42 |

FOREIGN PATENT DOCUMENTS

2216782 * 10/1989 (GB) .

* cited by examiner

*Primary Examiner*—Henry J. Recla
*Assistant Examiner*—Tuan Nguyen
(74) *Attorney, Agent, or Firm*—Renner, Kenner, Greive, Bobak, Taylor & Weber

(57) ABSTRACT

A bathtub tray (10) includes a planar base (20) having first and second opposed ends (26, 32). The first end (26) of the planar base having at least one drain hole (30) therethrough. The tray includes a leg (34) extending downwardly from the second end (32) of the planar base. The planar base (20) has a length sufficient to span opposed edges (14, 16) of a bathtub (12). The first end is adapted to be supported by one of the bathtub edges and the leg is adapted to be supported by the other bathtub edge. The leg imparts an incline to the planar base to direct any accumulated liquid on the planar base to at least one drain hole. A rim 22 extends upwardly from the planar base to assist in directing any accumulated liquid toward the drain hole, wherein the leg includes a suction cup (36) adapted to be supported by the other bathtub edge (16). A ridge (40) may extend from the planar base and may be positioned adjacent the drain hole to assist in the direction of accumulated water to the drain hole.

11 Claims, 2 Drawing Sheets

BATHTUB TRAY WITH DRAIN

CROSS REFERENCE TO RELATED APPLICATION

This application claims the benefit of U.S. Provisional Application Ser. No. 60/107,320, filed Nov. 6, 1998.

TECHNICAL FIELD

This invention relates to a tray for bathtubs. More particularly, this invention relates to a tray with drainage holes and an incline feature to safely dispense any accumulated liquid on the tray.

BACKGROUND ART

Although taking a bath is usually uneventful, there are some inherent dangers. For example, if a child inadvertently changes the temperature setting of the running water, they may be scalded by hot water. Slipping and falling while exiting or entering the tub, due to splashed water on the floor or tube edge, may also occur. There is also a similar risk of slipping within the tub and hitting the spigot or faucet handles. Still yet another mishap that may occur is when the child gets soap in his or her eyes and then loses their balance attempting to reach for a towel or washcloth.

Despite these hazards, bathtub time is generally fun as the children can play with toys such as rubber ducks, balls, cups, bubble bath, and the like. In order for these items to be readily at hand, they are often placed on an edge of the bathtub or on the floor adjacent the bathtub. As the child happens to reach for one item, another item is often knocked off of the edge and onto the floor. This splashes water onto the floor and creates an area where the child may slip upon exiting the bathtub.

The prior art has presented several different ways to carry or store soap, towels, and like items with wire-frame caddies, trays, and the like. Examples of wire-frame caddies are shown in U.S. Pat. Nos. 4,053,954; D343,321; and D265,152. Although these caddies are effective in their stated purpose, they are not ideal for younger children who may stick their fingers between the wires and get them stuck. Moreover, the wire-frame caddies are not easily stored, present a somewhat unpleasant appearance, and are difficult to clean.

It is also known to provide trays associated with the bathtubs as shown in U.S. Pat. Nos. 4,955,093; 5,548,855; and 5,669,313. The trays disclosed are primarily for holding books or providing vanity mirrors for use by adults. No consideration in these disclosures is given for use of the trays by children who are inclined to splash water and play with toys while taking a bath. As such, no provision is made to accommodate the accumulation of excess water on the tray.

Thus, the need exists for a bathtub tray with a tilt feature and drain hole designed to keep water in the tub area and off of the floor for the safety of children taking a bath and those assisting.

DISCLOSURE OF INVENTION

It is thus an object of the present invention to provide a bathtub tray for use with a bathtub, wherein the bathtub has a minimum of two side edges.

It is another object of the present invention to provide a bathtub tray, as above, with a base which has an upwardly extending rim which contains water on the tray.

It is a further object of the present invention to provide a bathtub tray, as above, wherein the rim has a channel underneath to allow grasping of the tray for installation onto and removal from the bathtub.

It is yet another object of the present invention to provide a bathtub tray, as above, wherein the tray is positionable upon the side edges of the tub for carrying bottles, toys, washcloths, and other items used while a child bathes.

It is yet another object of the present invention to provide a bathtub tray, as above, wherein the tray has drainage holes at predominantly one end thereof.

It is still another object of the present invention to provide a bathtub tray, as above, wherein the tray has legs or other supporting features which impart an incline angle to the tray, and wherein the leg is preferably at an end of the tray opposite the drainage holes and supported by one of the side edges of the bathtub to direct any accumulated water held by the tray toward the drainage holes.

It is still a further object of the present invention to provide a bathtub tray, as above, in which the legs provide suction cups to prevent slippage of the tray from the edge of the bathtub.

It is an additional object of the present invention to provide a bathtub tray, as above, wherein the tray has upwardly extending ridges disposed near the drainage holes to direct any accumulated water toward and through the drainage holes.

It is still yet another object of the present invention to provide a bathtub tray, as above, wherein the suction cups provided at one end of the tray may be employed to facilitate storage of the tray adjacent a wall near the bathtub.

These and other objects of the present invention, as well as the advantages thereof over existing prior art forms, which will become apparent from the description to follow, are accomplished by the improvements hereinafter described and claimed. In general, a bathtub tray includes a planar base having first and second opposed ends with one of the ends of the planar base having at least one drain hole therethrough. The supporting feature extends downwardly from the second end of the planar base for the purpose of tilting the tray toward the drainage hole. The planarbase has a length sufficient to span opposed edges of a bathtub such that the first end may be supported by one of the bathtub edges while the supporting feature is adapted to be supported by the other bathtub edge. This supporting feature, which imparts the tilt to the bathtub tray, inclines the planar base to direct any accumulated liquid on the planar base to the drainage hole.

In accordance with another aspect of the present invention, the bathtub tray may include a rim extending upwardly from the planarbase to retain any accumulated liquid on the planar base and to direct the liquid toward the drainage hole. To ensure that the tray does not become easily removed from its position, the supporting legs may be provided with a suction cup adapted to be supported by the bathtub edge to further assist the elevating of the second end. Still another feature of the invention is the utilization of a ridge extending from the planar base and positioned adjacent the drainage holes to assist in the direction of accumulated water through the drainage hole. It will also be appreciated that the suction cups can be used to facilitate storage of the tray at a substantially parallel position to a vertical wall near the bathtub. The base may also be provided with two tilted surfaces, wherein the drain holes are placed at the convergence of the tilted surfaces.

A preferred exemplary bathtub tray incorporated in the concepts of the present invention is shown by way of example in the accompanying drawings without attempting to show all the various forms and modifications in which the invention might be embodied, the invention being measured by the appended claims and not by the details of the specification.

BRIEF DESCRIPTION OF THE DRAWINGS

For a complete understanding of the objects, techniques and structure of the invention, reference should be made to the following detailed description and accompanying drawings, wherein.

PREFERRED EMBODIMENT FOR CARRYING OUT THE INVENTION

Figure 1:
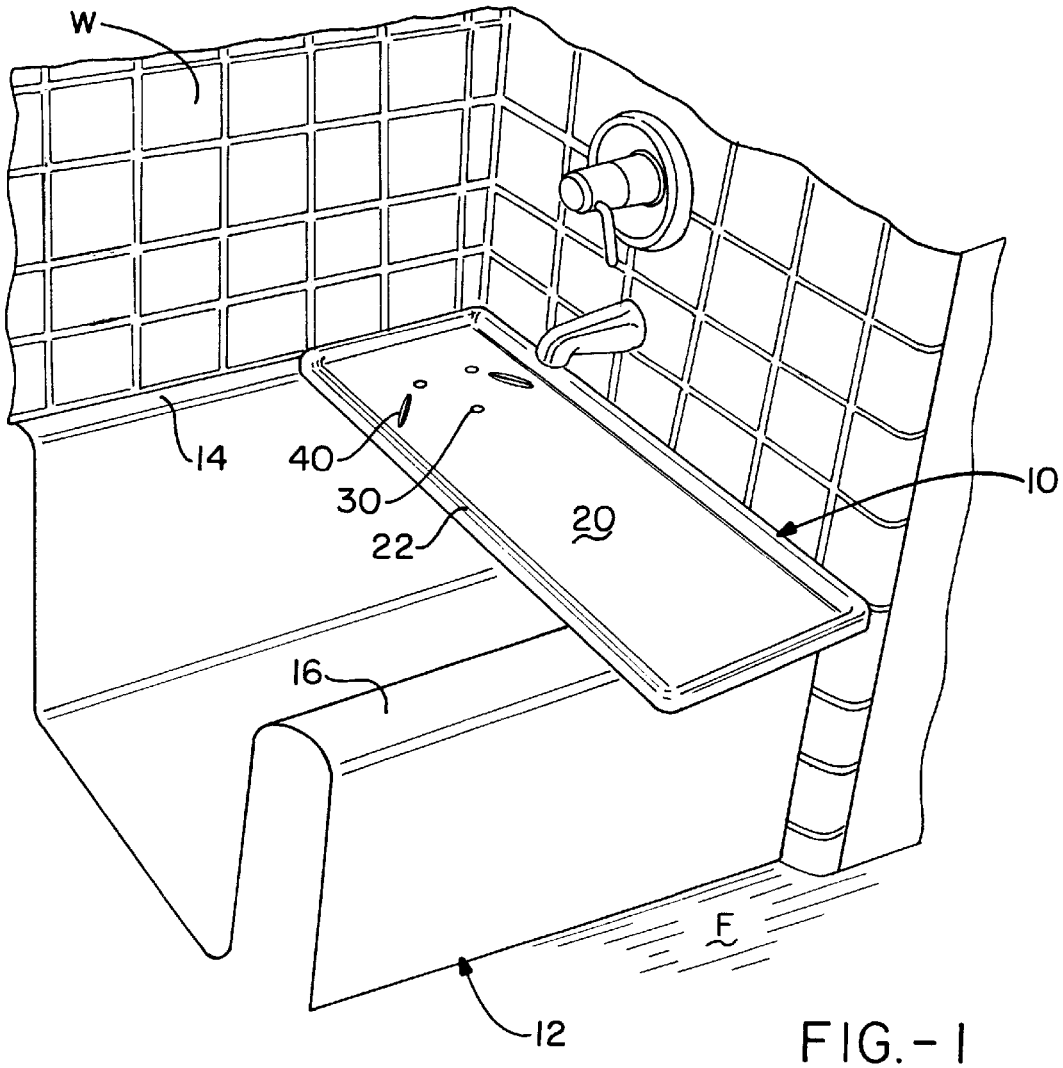
FIG. 1 is a perspective view of a bathtub tray made in accordance with the present invention and showing the tray disposed across edges of a bathtub.
Figure 3:
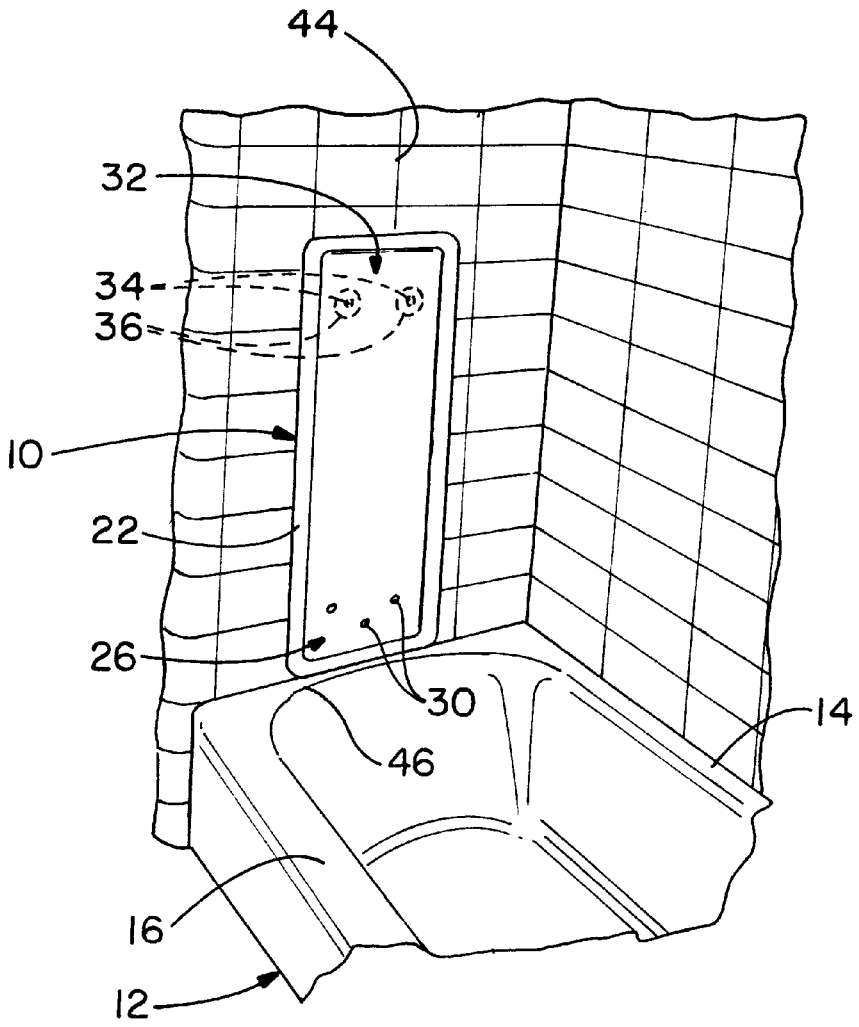
FIG. 3 is a perspective view of the bathtub tray shown in a surge position adjacent a bathtub wall.

A bathtub tray made in accordance with the concepts of the present invention is indicated generally the numeral 10 in the accompanying drawings and is preferably made of a suitable, inexpensively molded, plastic material. The bathtub tray 10, as best seen in FIG. 1, is used with a bathtub, generally indicated by the numeral 12. As is well known, the bathtub 12 is provided with a spigot and faucet handles which dispense water into the bathtub 12. The bathtub 12 shown in FIG. 1 includes a wall edge 14 opposite a side edge 16. Extending from the wall edge 14 is a wall generally designated by the capital letter W and wherein the bathtub 12 is supported by a floor generally indicated by the capital letter F. Although the bathtub shown in FIGS. 1 and 3 is of the type enclosed by a wall on three sides, it will be appreciated by those skilled in the art that any type of bathtub with side edges, and without walls, may employ the tray 10 described herein.

Figure 2:
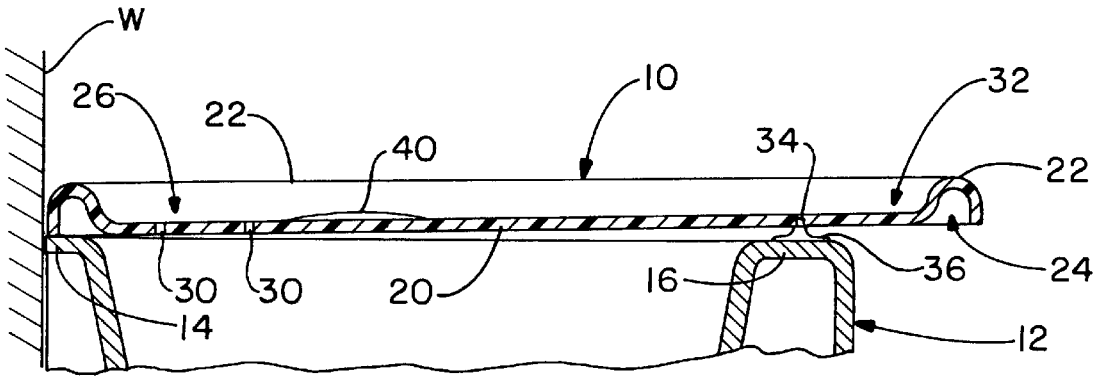
FIG. 2 is a cross-sectional view of the bathtub tray disposed across edges of the bathtub.

As best seen in FIGS. 1 and 2, the tray 10 includes a base 20 which is substantially planar, flat and rectangular in shape. Extending upwardly and around the outer periphery of the base 20 is a rim 22 which strengthens the tray and which also functions to retain water or other liquid on the base 20. The rim 22 precludes water from migrating from the tray to the floor. The rim 22 also forms a channel 24 on the underside thereof which allows for easy grasping of the tray 10 as it is placed across the edges of the tub and when it is placed for storage while not in use.

The tray 10 includes a drain end 26 positionable near and supported by the wall edge 14. Primarily disposed at the drain end 26 are a plurality of drain holes 30 which extend through the base 20. The drain holes 30 are preferably positioned near the drain end 26 close to the rim, although the holes could be disposed anywhere on the base.

The tray 10 also provides a tilt end 32 which is positionable on the side edge 16 of the bathtub 12. The tilt end 32 includes at least one leg 34 which is adapted to be supported by the side edge 16. Although two legs 34 are shown, it will be appreciated by those skilled in the art that the present invention may employ one or more downwardly extending legs as deemed necessary. The legs 34 may be provided with suction cups 36 disposed at each end thereof to further assist in elevating the tilt end 32 such that the tray 10 is inclined toward the wall edge 14. In other words, by employing a leg 34 at the tilt end 32, the tray is angled such that any liquid or water splashed upon the tray 10 is directed downwardly toward the drain holes 30 so that the water exits therethrough into the bathtub. An incline angle of 3° to 15° is preferred. The tilt end 32 may employ other structures for raising the tilt end above a level of the side edge 16. For example, a rib of material may extend downwardly from the base 20 along the width thereof or an inverted u-shaped bracket may enclose the side edge 16 and lift up the tilt end 32.

One or a plurality of ridges 40 may extend upwardly from the base 20 and be associated with each of the drainage holes 30 to further assist in the directing of water toward the holes so as to assist in the drainage process.

Referring now to FIG. 3, it can be seen that the bathtub 12 may be provided with a back wall 44 adjacent a back edge 46. As can be seen from the drawing, the back edge 46 connects the ends of the wall edge 14 to the side edge 16. After use, the tray 10 may be positioned such that the drain end 26 is supported by the back edge 46 and the suction cups 36 are positioned against the back wall 44. This allows storage of the tray 10, when not in use, in an out-of-the-way location.

Figure 4:
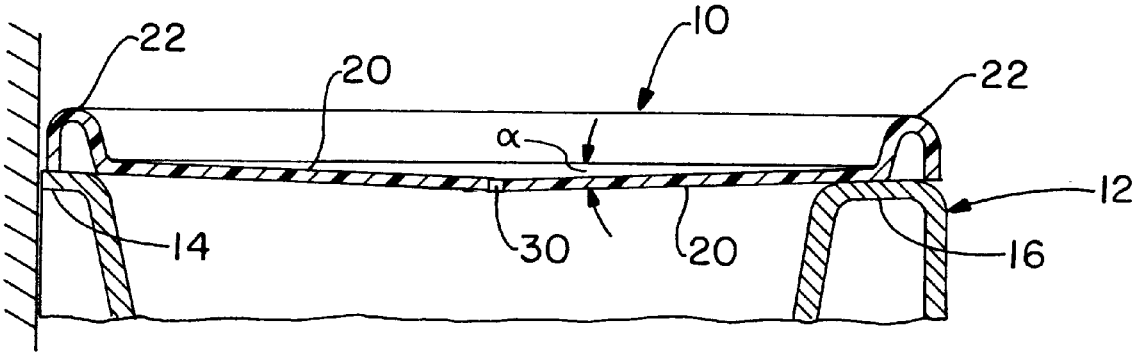
FIG. 4 is a cross-sectional view of an alternative bathtub tray.

Variations of the tub tray 10 are readily apparent from the above disclosure. For example, as seen in FIG. 4, a V-shaped tilt could be imparted to the base with the drainage holes located at the vertex of the V. This could be accomplished with or without use of legs at opposed ends of the tray. As shown, the base 20 is provided with a slight angle which facilitates the drainage of water, but remains level enough to support bottles without tipping. The angle is preferably 3° to 15°.

Based on the foregoing disclosure, the advantages of the present invention are readily apparent. Use of the tray 10 when positioned at the end of the bathtub near the faucet and spigot substantially precludes children from inadvertently turning the hot water on. This prevents possible burns to the child. Yet another advantage of the present invention is that toys, shampoo bottles, and other related items are carried on a tray instead of on the side edge 16. As such, if one of the bottles is accidently knocked over, it is likely to remain on the tray instead of falling to the floor. Since the item is likely wet, water is kept off the floor which significantly reduces the possibility of slipping and falling. Yet another advantage of the present invention is that by placing the tray near the spigot, a falling child is less likely to come in contact with a sharp-edged faucet. Still yet another benefit of the present invention is that it is inclined or imparted with an angle so as to direct water away from the floor and toward the drainage holes closely positioned near the wall of the bathtub. As such, water is precluded from accumulating on the tray and significantly reduces the possibility of water spilling onto the floor. Use of the suction cups 36 ensures that the tray 10 is detachably secured to the bathtub edges and can only be removed with a specific application of force. Removal of water from the tray is also facilitated by use of the ridges 40 which are angled with respect to the holes to encounter the downward flow of water from the tilt end 32 toward the drain end 26. Use of the suction cups 36 also allows for easy storage of the bathtub tray 10 when not in use. Yet another advantage of the present invention is that the rim 22 provides a rounded safe edge as opposed to sharp corners. It should also be noted that the tray may be placed in the center of the tub so that one child can play on either side of the tray. Still yet another advantage of the tray 10 is that it is easily cleaned as opposed to wire-frame caddies which require cleaning of each wire.

In view of the foregoing, it should thus be evident that a bathtub tray, constructed as described herein, accomplishes the objects of the present invention and otherwise substantially improves the art.

What is claimed is:

1. A bathtub tray, comprising:

a planar base having first and second opposed ends, said first end of said planar base having at least one drain hole therethrough; and means for tilting said planar base extending downwardly from said second end of said planar base, said planar base having a length sufficient to span opposed edges of a bathtub, said first end adapted to be supported on one of the bathtub edges, said tilting means adapted to be supported on the other bathtub edge, said tilting means imparting an incline to said planar base to direct any accumulated liquid on said planar base to said at least one drain hole.

2. The bathtub tray according to claim 1, further comprising:

a rim extending upwardly from said planar base to assist in directing any accumulated liquid toward said drain hole.

3. The bathtub tray according to claim 2, wherein said planar base has an outer periphery and said rim extends from said outer periphery.

4. The bathtub tray according to claim 2, wherein said rim forms a channel on the underside thereof.

5. The bathtub tray according to claim 1, wherein said tilting means includes one suction cup adapted to be supported by the other bathtub edge, said at least one suction cup elevating said second end.

6. The bathtub tray according to claim 5, wherein the bathtub has a back edge adjacent a back wall, said first end of said planar base adapted to be supported by the back edge, said at least one suction cup adapted to be detachably secured to the back wall.

7. The bathtub tray according to claim 1, further comprising:

a ridge extending from said planar base and positioned adjacent said at least one hole to assist in the direction of accumulated water to said drain hole.

8. A bathtub tray, comprising:

a planar base having first end with at least one drain hole therethrough and a second end, said planar base having a length sufficient to span opposed edges of a bathtub, said first end adapted to be supported on one of said bathtub edges;

a rim extending upwardly from said planar base; and a leg extending downwardly from said second end, said leg adapted to be supported on the other bathtub and imparting a tilt to the tray, such that the tilt and said rim direct any accumulated liquid on said planar base to said at least one drain hole and into the bathtub.

9. The bathtub tray according to claim 8, wherein said rim forms a channel on the underside thereof.

10. The bathtub tray according to claim 9, further comprising a ridge extending from said base and positioned proximally adjacent one of said at least one drain hole to assist in the flow of the accumulated liquid.

11. The bathtub tray according to claim 10, wherein said at least one drain hole is primarily positioned away from said leg.

* * * * *